US005430470A

United States Patent [19]

Stortz

[11] Patent Number: 5,430,470

[45] Date of Patent: Jul. 4, 1995

[54] INK JET PRINTHEAD HAVING A MODULATABLE COVER PLATE

[75] Inventor: James L. Stortz, Spring, Tex.

[73] Assignee: Compaq Computer Corporation, Houston, Tex.

[21] Appl. No.: 132,586

[22] Filed: Oct. 6, 1993

[51] Int. Cl.[6] ..... B41J 2/04; B41J 2/14

[52] U.S. Cl. ..... 347/54; 347/47

[58] Field of Search ..... 347/44, 47, 54, 68, 347/73–75; 239/102.1, 102.2, 4, DIG. 19

[56] References Cited

U.S. PATENT DOCUMENTS

| | | | |
|---|---|---|---|
| 3,786,517 | 1/1974 | Krause | 347/74 |
| 3,946,398 | 3/1976 | Kyser et al. | 346/1 |
| 3,958,249 | 5/1976 | DeMaine et al. | 347/47 |
| 4,536,097 | 8/1985 | Nilsson | 400/126 |
| 4,879,568 | 11/1989 | Bartky et al. | 346/140 |
| 4,887,100 | 12/1989 | Michaelis et al. | 346/140 |
| 5,077,565 | 12/1991 | Shibaike et al. | 347/54 X |
| 5,227,813 | 7/1993 | Pies et al. | 346/140 |
| 5,235,352 | 8/1993 | Pies et al. | 346/140 |

*Primary Examiner*—Benjamin R. Fuller
*Assistant Examiner*—Alrick Bobb
*Attorney, Agent, or Firm*—Konneker & Bush

[57] ABSTRACT

A drop on demand type ink jet printhead. The ink jet printhead includes a cover plate formed from an active material, a main body portion having an ink-carrying channel axially extending therein and a device for supplying a pressurized flow of ink to the ink-carrying channel. A rear side surface of the cover plate is mounted to a front side surface of the main body portion to block the ejection of pressurized ink therefrom. When an electric field is applied across the cover plate, the displacement of the cover plate caused thereby provides a path for the ejection of ink from the ink-carrying channel. Specifically, the cover plate includes an edge surface which extends from a front side surface thereof to the rear side surface such that, when the electric field is applied thereacross, an orifice defined by the edge surface and in communication with the ink-carrying channel is formed for the ejection of pressurized ink therefrom. The edge surface may be formed by respective side surfaces of first and second plate sections which lay flush with each other or first and second apertures formed in first and second plate sections which are mounted front to rear.

16 Claims, 3 Drawing Sheets

INK JET PRINTHEAD HAVING A MODULATABLE COVER PLATE

BACKGROUND OF THE INVENTION

1. Field of the Invention

The present invention relates to ink jet printing apparatus and, more particularly, to a drop on demand type ink jet printhead having a modulatable cover plate which controls the ejection of droplets of ink therefrom.

2. Description of Related Art

Printers provide a means of outputting a permanent record in human readable form. In general, printing techniques may be divided into two types—impact printing techniques and non-impact printing techniques. A very popular non-impact printing technique is generally classified as ink jet printing. Ink jet printing systems use the ejection of tiny droplets of ink to produce an image. The devices produce highly reproducible and controllable droplets so that a droplet may be printed at a location specified by digitally stored image data.

Most ink jet printing systems commercially available may be generally classified as either a "continuous jet" type ink jet printing system where droplets are continuously ejected from the printhead and either directed to or away from the paper depending on the desired image to be produced or as a "drop on demand" type ink jet printing system where droplets are ejected from the printhead in response to a specific command related to the image to be produced.

In a continuous jet type ink jet printer, a pump continuously supplies ink to a nozzle assembly where the pumping pressure forces the supplied ink to be ejected therefrom in a continuous stream. The nozzle assembly includes a piezo crystal continuously driven by an electrical voltage, thereby creating pressure disturbances that cause the continuous stream of ink ejected therefrom to break up into uniform droplets of ink. The droplets acquire an electrostatic charge due to the presence of an electrostatic field established close to the ejection orifice. Using high voltage deflection plates, the trajectory of selected ones of the electrostatically charged droplets can be controlled to hit a desired spot on a sheet of paper. The high voltage deflection plates can also deflect unselected ones of the electrostatically charged droplets away from the sheet of paper and into a reservoir for recycling purposes. Due to the small size of the droplets and the precise trajectory control, the quality of continuous jet type ink jet printing systems can approach that of formed-character impact printing systems. However, the primary drawback to continuous jet type ink jet printing systems is that fluid must be continuously jetting, even when little or no printing is required. This requirement degrades the ink and decreases reliability of the printing system.

Due to this drawback, there has been increased interest in those ink jet printing systems in which droplets of ink are ejected from the printhead by electromechanically inducing pressure waves in the fluid. In this type of printing system, a volumetric change in the fluid is induced by the application of a voltage pulse to a piezoelectric material which is directly or indirectly coupled to the fluid. This volumetric change causes pressure/velocity transients to occur in the fluid, thereby causing the ejection of a droplet therefrom. Since the voltage is applied only when a droplet is desired, these types of ink jet printing systems are referred to as drop on demand type ink jet printing systems.

A typical drop on demand type ink jet printing system is disclosed in U.S. Pat. No. 3,946,398 to Kyser et al. In Kyser et al., a pressure plate formed from two transversely expandable piezoelectric plates is utilized as the upper wall of an ink-carrying pressure chamber. By applying a voltage across the piezoelectric plates, the pressure plate flexes inwardly into the pressure chamber, thereby causing a fluid displacing volumetric change within the chamber. Another typical drop on demand type ink jet printing system is disclosed in U.S. Pat. No. 4,536,097 to Nilsson. In Nilsson, an ink jet channel matrix is formed using a series of piezoelectric strips disposed in spaced parallel relationship with each other and covered by a plate on both sides. One plate is constructed of a conductive material and forms a shared electrode for all of the strips of piezoelectric material. On the other side, electrical contacts are used to electrically connect channel defining pairs of the strips of piezoelectric material. When a voltage is applied to the two strips of piezoelectric material which define a channel, the strips become narrower and higher such that the enclosed cross-sectional area of the channel is enlarged and ink is drawn into the channel. When the voltage is removed, the strips return to their original shape, thereby reducing the channel volume and ejecting ink therefrom. Other, albeit shear mode, ink jet printing systems which utilize separate sections of a piezoelectric material to form individual actuator walls for an ink-carrying channel are disclosed in U.S. Pat. Nos. 4,879,568 to Bartky et al. and 4,887,100 to Michaelis et al.

The major drawback to drop on demand type ink jet printing systems such as those disclosed in Kyser et al., Nilsson, Bartky et al. and Michaelis et al. is the difficulty in manufacturing an ink jet printhead, particularly a large array or high density ink jet printheads, in such configurations. Each of these configurations utilize a separate actuator piece for each channel. Accordingly, to construct such a printhead, a large number of individual parts must be used to assemble the channel array. Electrical contacts are either separately attached to each actuator before assembly or attached after the channel array is assembled, either of which is a very time consuming operation. Due to the large number of steps required to assemble such a printhead, the manufacture of such a printhead, in particular one having a nozzle density greater than 100 nozzles per inch has proven difficult, as well as often cost prohibitive, in practice.

The present invention represents a significant departure from prior drop on demand type ink jet printheads in that an inactive channel array having no channel actuators incorporated therein is utilized. As a result, the construction of the channel array has been simplified dramatically in comparison with prior systems. Furthermore, by eliminating the use of an acoustic wave to control the ejection of ink from the printhead, enhanced modulation of the droplet has become possible.

SUMMARY OF THE INVENTION

The present invention is of a drop on demand type ink jet printhead which includes a cover plate formed from an active material, a main body portion having an ink-carrying channel axially extending therein and means for supplying a pressurized flow of ink to the ink-carrying channel. A rear side surface of the cover plate is mounted to a front side surface of the main body portion to block the ejection of pressurized ink therefrom. When an electric field is applied across the cover plate, the displacement of the cover plate caused thereby provides a path for the ejection of ink from the ink-carrying channel. The cover plate may further include an edge surface which extends from a front side surface thereof to the rear side surface such that, when the electric field is applied thereacross, an orifice defined by the edge surface and in communication with the ink-carrying channel is formed for the ejection of pressurized ink therefrom.

In one aspect of the invention, the cover plate is comprised of first and second plate sections having respective side surfaces which lay flush with each other to define the edge surface of the cover plate such that, when the electric field is applied thereacross, the field separates the side surfaces to form the orifice. In another aspect of the invention, the cover plate is comprised of a first plate section having a rear side surface mounted to the front side surface of the main body portion and a second plate section having a rear side surface mounted to a front side surface of the first plate section. In this aspect of the invention, first and second apertures extending through the first and second plate sections, respectively, define the edge surface of the cover plate. When the electric field is applied across the plate sections, the cover plate is deflected from a rest position where the cover plate blocks the ejection of pressurized ink from the ink-carrying channel to a displaced position where a droplet of pressurized ink is ejected through the orifice. In yet another aspect of the invention, the first and second apertures are in communication in both the rest and the deflected positions. Here, in the rest position, both of the apertures have diameters insufficiently sized for the passage of ink therethrough but, in the displaced position, have diameters sufficiently sized for the passage of ink therethrough. In still yet another aspect of the invention, the first and second apertures have diameters sufficiently sized for the passage of ink therethrough in both the rest and deflected positions. Here, however, the first and second apertures are formed at first and second locations on the first and second plate sections, respectively, such that, in the rest position, the apertures are not in communication with each other and the rear side surface of the second plate section blocks the ejection of ink from the ink-carrying channel, but, in the deflected position, the first and second apertures are in communication with each other, thereby permitting the passage of ink therethrough.

BRIEF DESCRIPTION OF THE DRAWING

The present invention may be better understood, and its numerous objects, features and advantages will become apparent to those skilled in the art by reference to the accompanying drawing, in which.

DETAILED DESCRIPTION

Figure 1:
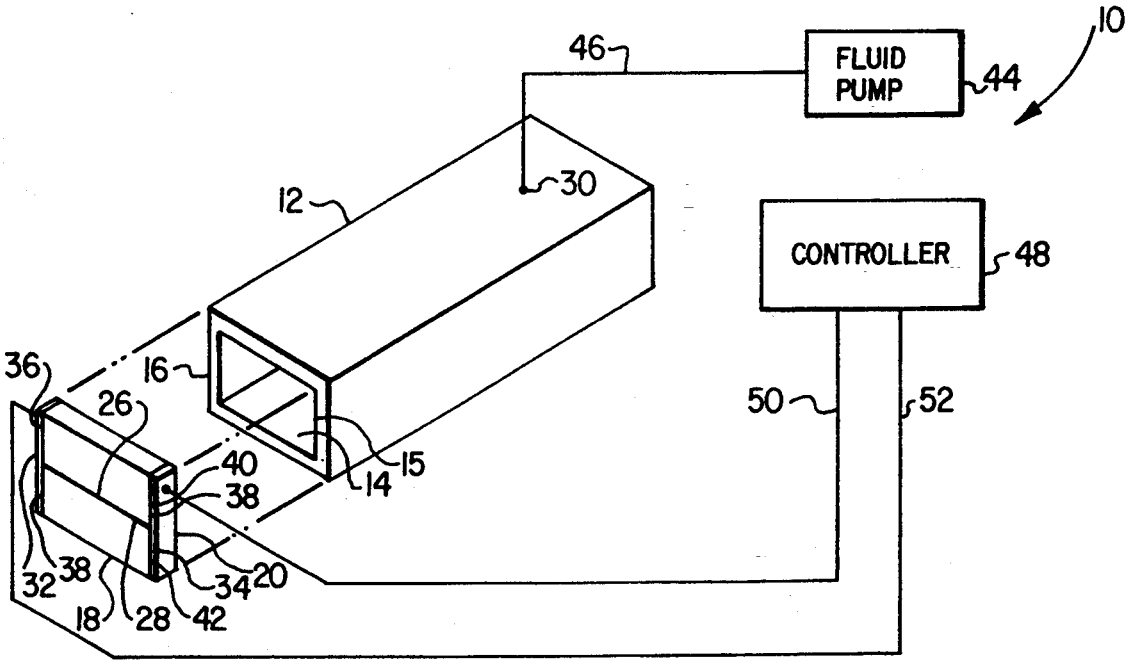
FIG. 1 is a perspective view of a schematically illustrated drop on demand type ink jet printhead constructed in accordance with the teachings of the present invention and configured as a single channel printhead.

Referring now to the drawing wherein thicknesses and other dimensions have been exaggerated in the various figures as deemed necessary for explanatory purposes and wherein like reference numerals designate the same or similar elements throughout the several views, in FIG. 1, a single channel, drop on demand type ink jet printhead 10 constructed in accordance with the teachings of the present invention may now be seen.

The ink jet printhead 10 includes a main body portion 12 having an ink-carrying channel 14 extending from an interior back wall (not shown) of the main body portion 12 to an aperture 15 formed in a front side surface 16 of the main body portion 12. Preferably, the main body portion 12 is constructed of an inactive material and may be formed using either conventional injection molding or extrusion techniques. An orifice plate 18 is mounted to the front side surface 16 of the main body portion 12, for example, by applying a layer (not shown) of an adhesive material to the periphery of the front side surface 16 which surrounds the aperture 15 and bonding a back surface 20 of the cover plate 18 to the front side surface 16, thereby covering the aperture 15 of the ink-carrying channel 14.

Figures 2A, 2B, 2C:
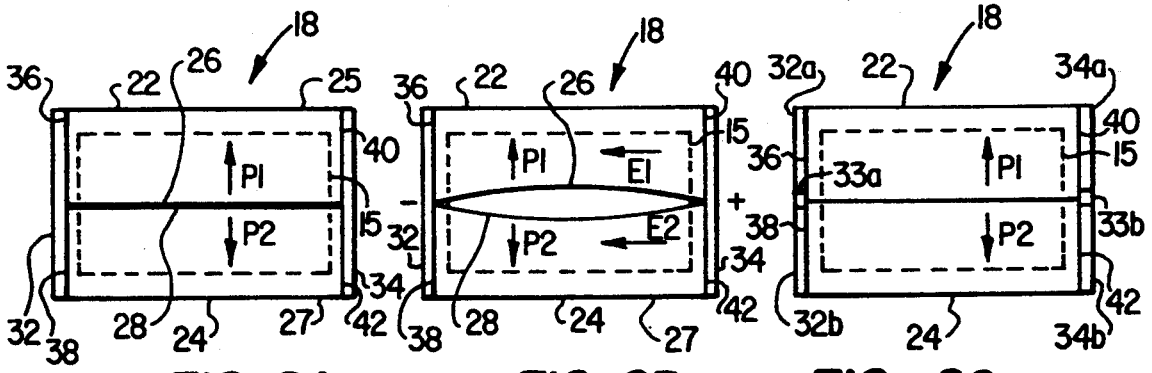
FIG. 2A is a front view of the ink jet printhead of FIG. 1.
FIG. 2B is a front view of the ink jet printhead of FIG. 2A during actuation.
FIG. 2C is a front view of an alternate embodiment of the ink jet printhead of FIG. 2A.

Referring next to FIGS. 2A-C, the cover plate 18 is constructed of first and second sections 22, 24, each constructed of an active piezoelectric material such as lead zirconate titanate (or "PZT") or polyvinylidene fluoride (or "PVDF2") and, positioned such that a side surface 26 of the first section 22 lies flush with a side surface 28 of the second section 24 to define an edge surface therebetween. The first section 22 is poled in a first direction P1 generally orthogonal to the side surface 26 and the direction of axial extension of the ink carrying channel 14. For example, the first section 22 may be poled in the direction P1 by metallizing side surfaces 25, 26, for example, using a conventional deposition process, applying a positive voltage to the side surface 26 while holding the side surface 25 to ground to polarize the first section 22 and then removing the metallization, again using conventional techniques. Similarly, the second section 24 is poled in a second direction P2 generally orthogonal to the second side surface 28 and the direction of axial extension of the ink-carrying channel 14 and may be poled in the direction P2 using the poling technique described above. The cover plate 18 further includes a first strip 32 of conductive material, for example, metal, mounted to side surfaces 36, 38 of the first and second sections 22, 24, respectively, and a second strip 34 of conductive material is mounted to side surfaces 40, 42 of the first and second sections 22, 24, respectively.

Returning momentarily to FIG. 1, from the top wall of the main body portion 12, an aperture 30 extends through the interior of the main body portion 12 until communicating with the ink-carrying channel 14. Ink is supplied to the ink jet printhead 10 by a fluid pump 44 which continuously pumps a pressurized stream of ink via a conduit 46, through the aperture 30 and into the ink-carrying channel 14. However, as will be more fully described below, the cover plate 18 mounted to the front side surface 16 of the main body portion 12 is, in effect, orificeless except during the actuation of the ink jet printhead 10. Accordingly, no ink will be ejected from the printhead 10 except when an ejection path through the cover plate 18 is formed.

The ink jet printhead 10 further includes a controller 48 for example, a microprocessor or other integrated circuit of conventional design. Electrically connected to the controller 48 are first and second conductive leads 50, 52 which are electrically connected to the first and second conductive strips 34, 32, respectively. While the controller 48 is illustrated at a remote location relative to the ink jet printhead 10, it is further contemplated that the controller 48 may be mounted along the top wall of the main body portion 12 or other suitably sized location along the surface of the ink jet printhead 10. As will be more fully described below, the controller 48 controls the operation of the ink jet printhead 10 by selectively applying a series of positive and negative voltages to the conductive strips 32, 34 in accordance with a pulse sequence related to both the time at which, as well as the volume of, a droplet of ink is to be ejected by the ink jet printhead 10.

Referring next to FIGS. 2A and 2B, the actuation of the ink jet printhead 10 will now be described in greater detail. In FIG. 2A, the first and second sections 22 and 24 are in respective first, undeflected, positions. Furthermore, as the side surfaces 26, 28 of the sections 22, 24 lie flush with each other, no droplets of ink can be ejected from the ink jet printhead 10. To fire the ink-carrying channel 14, the controller 48 applies a positive voltage to the conductive strip 34 and a negative voltage to the conductive strip 32, thereby forming electric fields E1 and E2 across the first and second sections 22 and 24, respectively. By applying an electric field E generally orthogonal to both the poling direction P of one of the sections 22, 24 of active piezoelectric material and the direction of axial extension of the ink-carrying channel 14, the sections 22, 24 will attempt to deform in shear. More specifically, when the controller 48 generates electric fields E1 and E2 across the first and second sections 22, 24, the first and second sections will attempt to shear in the poling directions P1 and P2, respectively. However, as the first and second sections 22, 24 are restrained along the side surfaces 36, 22 and 40, 38, 24 and 42, respectively, the first and second sections 22, 24 will deflect in the manner illustrated in FIG. 2B, thereby separating the side surfaces 26 and 28. As the first and second sections 22, 24 deflect as illustrated in FIG. 2B, an orifice bounded by the edge surface defined by the sides surfaces 26, 28 and in communication with the ink-carrying channel 14 will be formed. Pressurized ink previously restrained in the ink-carrying channel by the cover plate 18 will be ejected via the orifice and towards a surface (not shown) of a recording media (also not shown). Furthermore, by appropriate selection of the characteristics of the electric field to be applied across the first and second sections 22, 24, the resultant modulation of the cover plate 18 may be modified to control the ejection of ink from the ink jet printhead. Specifically, the volume of the droplet ejected from the ink-carrying channel may be modified by varying the strength of the applied electric fields or the period of time during which the field is applied.

Referring next to FIG. 2C, an alternate embodiment of the cover plate 18 may now be seen. In this embodiment, separate conductive strips are provided for the selective application of electric fields across the sections 22, 24. More specifically, for the first section 22, a first conductive strip **32*a* is mounted to the sidewall 36 and a second conductive strip 34*a* is mounted to the sidewall 40. Similarly, for the second section, a third conductive strip 32*b* is mounted to the sidewall 38 and a fourth conductive strip 34*b* is mounted to the sidewall 42. Preferably, the first and third conductive strips 32*a* and 32*b* are separated by a strip 33*a* of insulative material and the second and fourth conductive strips 34*a* and 34*b* are separated by a strip 33*b* of insulative material. In this manner, the electric fields E1 and E2 may be separately applied, thereby providing further capability to control the modulation of the cover plate 18**.

Figure 3:
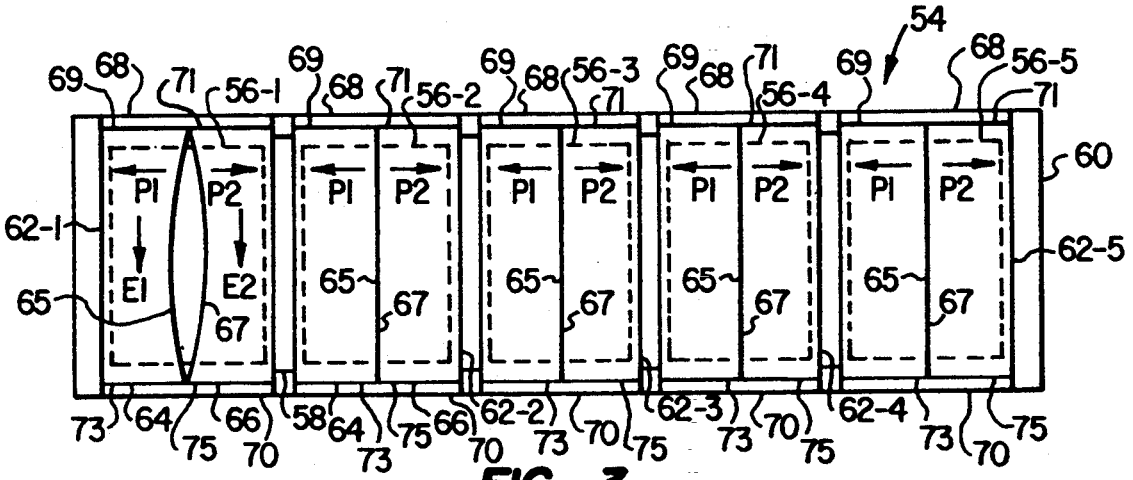
FIG. 3 is a front view of the ink jet printhead of FIGS. 1-2C configured as a multiple channel printhead.

Referring next to FIG. 3, a multiple channel ink jet printhead 54 constructed in accordance with the teachings of the present invention may now be seen. The ink jet printhead 54 includes a plurality of axially extending, generally parallel, ink-carrying channels 56-1, 56-2, 56-3, 56-4 and 56-5 which, like the single ink-carrying channel illustrated in FIG. 1, extends from an interior back wall (not shown) within the main body portion 58 to a corresponding aperture in the front surface thereof. Preferably, the main body portion 58 is constructed of an inactive material and may be formed using either conventional injection molding or extrusion techniques. It should be noted, however, that a five channel ink jet printhead channel array has been shown in FIG. 3 for ease of illustration, it is specifically contemplated that the main body portion 58 may be constructed to included any number of ink-carrying channels 56 axially extending therethrough without departing from the scope of the invention.

A support frame 60, preferably formed of a flexible polyimide material, is mounted to the front surface of the main body portion 58 along the outer periphery thereof. Mounted to the support frame 60 and positioned such that a back surface thereof will lay flush with the front surface of the support frame 60 are a series of cover plates 62-1, 62-2, 62-3, 62-4, and 62-5, each one of which covers a corresponding one of the channels 56-1, 56-2, 56-3, 56-4, 56-5 axially extending through the main body portion 58 to block the ejection of ink therefrom. As before, each cover plate 62-1 through 62-5 is comprised of a first section 64 formed of an active piezoelectric material poled in direction P1 and a second section 66 formed of an active piezoelectric material poled in direction P2 positioned such that a side surface 65 of the first section 64 lies flush with a side surface 67 of the second section 66 to define an edge surface therebetween. Each cover plate 62-1 through 62-5 further includes a first strip 68 of conductive material mounted to side surfaces 69, 71 of the first and second sections 64, 66, respectively, and a second strip 70 of conductive material mounted to side surfaces 73, 75 of the first and second sections 64, 66, respectively. Each of the first and second strip 68, 70 of conductive material are electrically connected to a controller configured to selectively apply a positive, zero, or negative voltage thereto.

To construct the ink jet printhead 54, the main body portion 58 would be formed and the support frame 60 mounted thereto. Each cover plate 62 is constructed by positioning the first and second sections 64 and 66 side by side such that the side surfaces 65 and 67 lay flush with one another. The conductive strips 68, 70 are then mounted to the side surfaces 69 and 71, 73 and 75, respectively. Once constructed, each cover plate 62 is securedly mounted on the support frame 60 such that the cover plate 62 is positioned to cover one of the ink-carrying channels 56. Each cover plate 62 is spaced apart a small distance relative to an adjacent cover plate to allow sufficient clearance for any possible deflection therebetween. Each conductive strip 68, 70 is then electrically connected to the controller such that the controller can selectively apply a positive, zero or negative voltage thereto. In an alternate embodiment of the invention, each cover plate 62 is electrically connected to a common potential along one side surface thereof. To do so, only the conductive strips 68 would be mounted to the cover plates 62 prior to the mounting thereof to the support frame 60. A single conductive strip 70 would be mounted to the side surfaces 73, 75 for each of the cover plates 62 mounted to the support frame 60 and connected to ground. In this manner, the total number of electrical connections between the controller and the ink jet printhead would be reduced by about half.

As may be seen in FIG. 3, the ink-carrying channels 56-2 through 56-5 are inactive. To fire a channel, for example, the channel 56-1, a positive voltage would be applied to the conductive strip 68 and a negative or zero voltage applied to the conductive strip 70, thereby creating electric fields E1 and E2, each generally orthogonal to both the poling direction and the axial extension of the ink-carrying channel, across the plate sections 64 and 66, respectively. When electric fields E1 and E2 are applied thereacross, the plate sections 64, 66 will attempt to deflect in shear. However, as the plate sections 64, 66 are restrained along the side surfaces thereof, the sections 64, 66 will deform as illustrated in FIG. 3, thereby separating the side surfaces 65 and 67. As the first and second sections 64, 66 deflect, an orifice bounded by the edge surface defined by the sides surfaces 65, 67 and in communication with the ink-carrying channel 14 will be formed. Pressurized ink previously restrained in the ink-carrying channel by the cover plate 62 will be ejected via the orifice and towards the surface of the recording medium.

Figure 4:
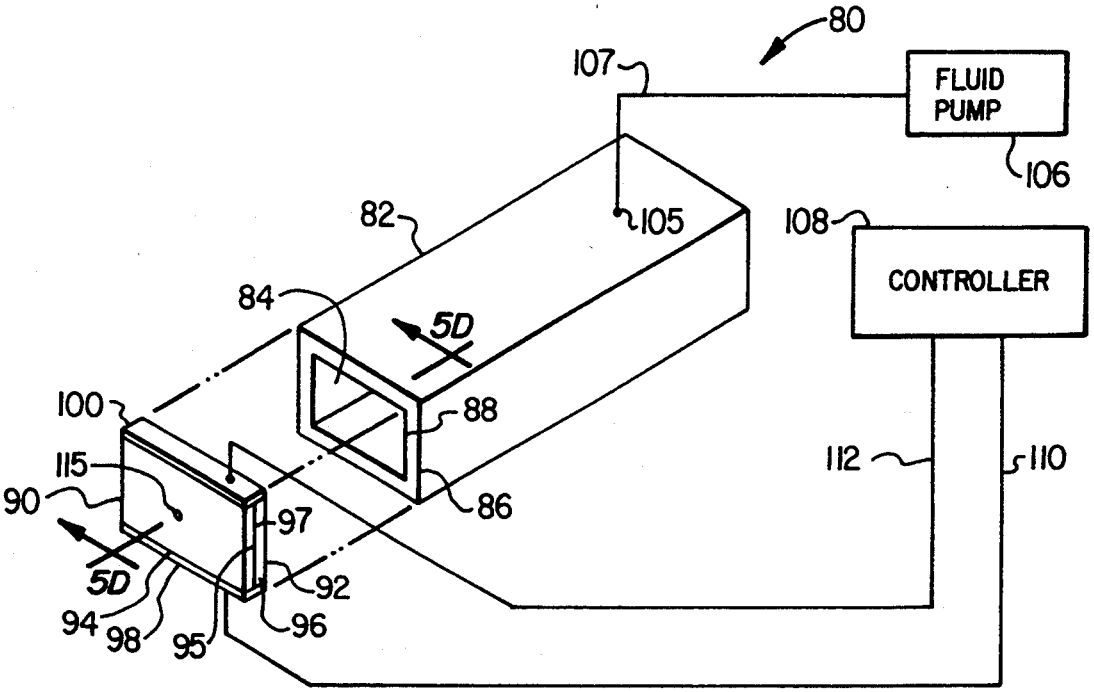
FIG. 4 is a perspective view of a second schematically illustrated drop on demand type ink jet printhead constructed in accordance with the teachings of the present invention.

Referring next to FIG. 4, yet another embodiment of the invention will now be described in greater detail. As may now be seen, the ink jet printhead 80 includes a main body portion 82 having an ink-carrying channel 84 extending from an interior back wall (not shown) of the main body portion 82 to an aperture 88 formed in a front surface 86 of the main body portion 82. As before, the main body portion 82 is preferably constructed of an inactive material and may be formed using either conventional injection molding or extrusion techniques. An orifice place 90 is mounted to the front surface 86 of the main body portion 82, for example, by applying a layer (not shown) of an adhesive material to the periphery of the front surface 86 which surrounds the aperture 84 and bonding a back surface 92 of the cover plate 90 to the front surface 86, thereby covering the aperture 88 of the ink-carrying channel 84.

The cover plate 90 is constructed of first and second sections 94, 96, each constructed of an active piezoelectric material such as PVDF2. A back side surface 95 of the first section 94 is cemented to a front side surface 97 of the second section 96. A first strip 98 of conductive material is mounted to a side surface 101 of the first section 94 and a side surface 102 of the second section 96. Similarly, a second strip 100 of conductive material is mounted to a side surface 103 of the first section 94 and a side surface 104 of the second section 96. The sections 94, 96 are poled in specific directions such that the cover plate 90 will operate as a bimorph cell wherein one of the sections 94, 96 will attempt to expand while the other of the sections 94, 96 attempt to compress in response to the application of an electric field across the cover plate 90, thereby producing a bending of the two as illustrated in FIG. 5B.

From the top wall of the main body portion 82, an aperture 105 extends through the interior of the main body portion 82 until communicating with the ink-carrying channel 84. Ink is supplied to the ink jet printhead 80 by a fluid pump 106 which continuously pumps a pressurized stream of ink via a conduit 107, through the aperture 105 and into the ink-carrying channel 84. However, as will be more fully described below, the cover plate 90, when mounted to the front surface 86 of the main body portion 82 is, in effect, orificeless except during the actuation of the ink jet printhead 80. Accordingly, no ink will be ejected from the ink jet printhead 80 except when an ejection path through the cover plate 90 is provided. While an orifice 115 which is defined by an edge surface and extends through the general center of the cover plate 90, the orifice 115 has a diameter insufficiently sized to permit the ejection of a droplet of ink therethrough when the cover plate 90 is in a first, rest position illustrated in FIG. 4.

The ink jet printhead 10 further includes a controller 108 for example, a microprocessor or other integrated circuit of conventional design. Electrically connected to the controller 108 are first and second conductive leads 110, 112 which are electrically connected to the first and second conductive strips 98, 100, respectively. Again, while the controller 108 is illustrated at a remote location relative to the ink jet printhead 80, it is further contemplated that the controller 108 may be mounted along the top wall of the main body portion 82 or other suitably sized location along the surface of the ink jet printhead 80. As will be more fully described below, the controller 108 controls the operation of the ink jet printhead 80 by selectively applying a series of positive and negative voltages to the conductive strips 98, 100 in accordance with a pulse sequence related to both the time at which, as well as the volume of, a droplet of ink is to be ejected by the ink jet printhead 80.

Figure 5A:
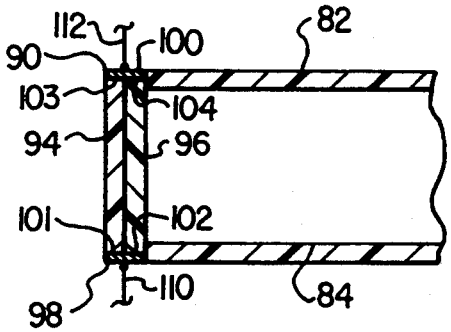
FIG. 5A is a first cross-sectional view of the ink jet printhead of FIG. 4 taken during the construction thereof.
Figure 5B:
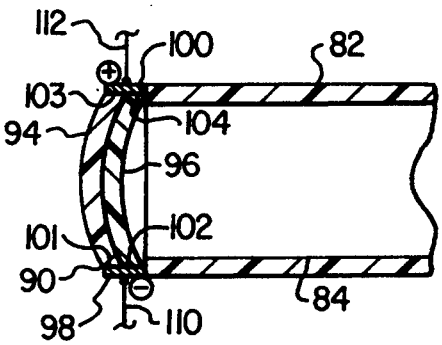
FIG. 5B is a second cross-sectional view of the ink jet printhead of FIG. 4, again taken during the construction thereof, in which the orifice plate has been activated.

Referring next to FIGS. 5A–5E, the methods of both forming and operating the ink jet printhead 80 will now be described in greater detail. As may be seen in FIG. 5A, the cover plate 90, when first mounted to the front surface 86 of the ink jet printhead 80 to block the ink-carrying channel 84, is orificeless. As may be seen in FIG. 5B, a positive voltage is then applied to the conductive strip 100 and a negative voltage applied to the conductive strip 102. By applying the aforementioned voltages thereto, the second section 96 would attempt to contract and the first section 94 would attempt to expand. As the second section 96 is restrained along its entire periphery by the front end 86 of the main body portion 82 and the first section 94 is cemented to the second section 96, the cover plate will, as illustrated in FIG. 5B, flex outwardly.

Figure 5C:
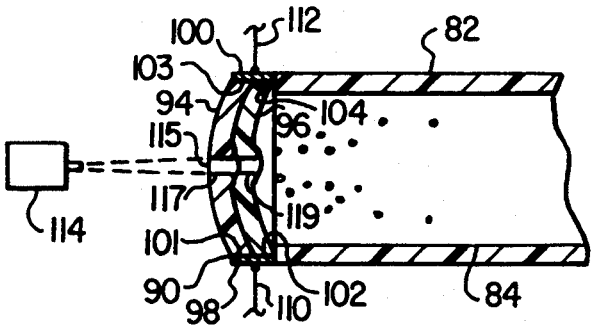
FIG. 5C is a third cross-sectional view taken of the ink jet printhead of FIG. 4, yet again taken during the construction thereof, in which orifices are being formed in the activated orifice plate.
Figure 5D:
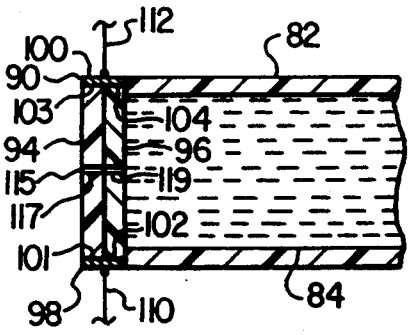
FIG. 5D is a cross-sectional view of the ink jet printhead of FIG. 4 taken along lines 5D—5D of FIG. 4.
Figure 5E:
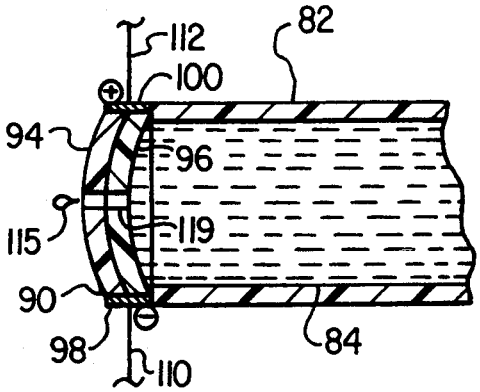
FIG. 5E illustrates the ink jet printhead of FIG. 5D during actuation.

Referring next to FIG. 5C, after applying an electric field to cause the cover plate 90 to deform in the illustrated manner, a laser 114 is used to ablate an orifice segments 117, 119 in the general center of the sections 94, 96, respectively, thereby forming the orifice 115 which extends through the cover plate 90, is in communication with the ink-carrying channel 84 and has a diameter sufficiently sized for the ejection of ink therethrough. After forming the orifice 115, the electric field is then removed, thereby allowing the cover plate 90 to return to its original rest position. As may be seen in FIG. 5D, since the orifice 115 was formed while the cover plate was flexed outwardly, when the electric field is removed and the cover plate returns to its original rest position, the diameter of the orifice 115 shrinks to a considerably lesser diameter insufficiently sized for the ejection of ink therethrough. As may be seen in FIG. 5E, whenever it is desired to eject a droplet of ink, the controller 108 will again flex the cover plate 90 by applying a positive voltage to the conductive strip 100 and a negative voltage to the conductive strip 98. As the cover plate 90 flexes, the diameter of the orifice 115 grows until it is sufficiently sized so that a droplet of the pressurized ink contained in the ink-carrying channel 84 is ejected therethrough. After the ink droplet has been ejected, the cover plate 90 is returned to its rest position. Depending on the pressure exerted by the pressurized ink contained in the ink-carrying channel 84 and the viscosity of that ink, some leakage of ink through the reduced diameter orifice 115 is possible, although any such ink would have insufficient velocity to strike the recording medium. However, as the continual leakage of ink could degrade the performance of the ink jet printhead 80, it is contemplated that, in those situations where leakage is of concern, the ink contained in the ink-carrying channel will be depressurized whenever the cover plate 90 returns to the rest position after the ejection of a droplet of ink therefrom. Furthermore, before instructing the cover plate 90 to eject a next droplet of ink by flexing a next time, the controller 108 will first instruct the fluid pump 106 to repressurize the ink contained in the ink-carrying channel 84.

Figure 6:
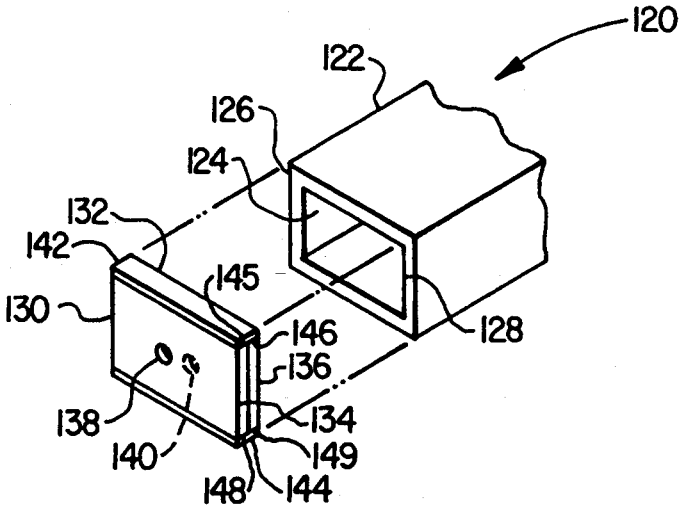
FIG. 6 is a perspective view of a third schematically illustrated drop on demand type ink jet printhead constructed in accordance with the teachings of the present invention.

Referring next to FIG. 6, yet another ink jet printhead 120 constructed in accordance with the teachings of the present invention will now be described in greater detail. As may now be seen, the ink jet printhead 120 includes a main body portion 122 having an ink-carrying channel 124 extending from an interior back wall (not shown) of the main body portion 122 to an aperture 128 in a front surface 126 of the main body portion 122. As in the prior embodiments of the invention, the main body portion 122 is preferably constructed of an inactive material and may be formed using either conventional injection molding or extrusion techniques. A cover plate 130 similarly configured as the cover plate 90 is mounted to the front surface 126 of the main body portion 122, for example, by applying a layer (not shown) of an adhesive material to the front surface 126 and bonding a back surface 132 of the cover plate 130 to the front surface 126, thereby covering the front end of the ink-carrying channel 124.

While similarly configured to the cover plate 90, the cover plate 130 includes first and second sections 134, 136, each constructed of an active piezoelectric material such as PVDF2 and having a generally circular aperture 138, 140, extending therethrough. As may be seen in FIG. 6, the apertures 138, 140 are positioned such that, when the cover plate 130 is mounted to the main body portion 122, each of the apertures 138,140 are relatively close to the general center of the ink-carrying channel 124 but are positioned such that the apertures 138 and 140 are not in communication with each other. A first conductive strip 142 is mounted to a side surface 145 of the first section 134 and a side surface 146 of the second section 136. Similarly, a second conductive strip 144 is mounted to a side surface 148 of the first section 134 and a side surface 149 of the second section 135. The sections 134, 136 are poled in specific directions such that the cover plate 130 will operate as a bimorph cell wherein one of the sections 134, 136 will attempt to expand while the other section 134, 136 will attempt to compress in response to the application of an electric field across the cover plate 130, thereby producing a bending of the two.

Figure 7:
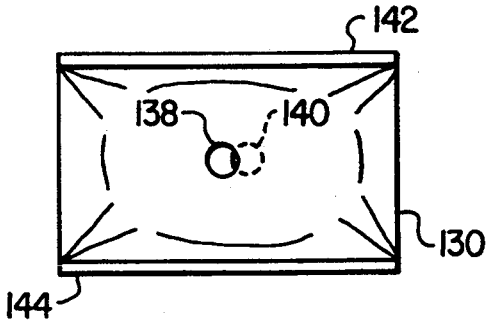
FIG. 7 is a front view of the ink jet printhead of FIG. 6 during actuation.

Pressurized ink is continuously supplied to the ink-carrying channel 124 by a fluid pump (not shown) such as the pump previously described in FIG. 4. As the channel 124 is in communication with the aperture 140, the aperture 140 will be filled with ink. However, as the aperture 138 is not in communication with the aperture 140, no ink will be ejected from the ink jet printhead 120. When the cover plate 130 is flexed by the simultaneous application of a positive voltage to the conductive strip 132 and a negative voltage to the conductive strip 134, for example using a controller (not shown) electrically connected to the conductive strips 132, 134 in a manner similar to that illustrated in FIG. 4, the first section 132 would attempt to contract and the second section 134 would attempt to expand. However, as the first section 132 is restrained along its entire periphery by the front surface 126 of the main body portion 122 and the second section 134 is cemented to the first section 132, the cover plate 130 will, as illustrated in FIG. 7, flex outwardly with respect to the ink-carrying channel 124. By applying an electric field to cause the cover plate 130 to deform in the illustrated manner, the apertures 138, 140 move into communication with each other, thereby providing a exit path from the ink-carrying channel 124 which extends through the cover plate 130. As the ink held in the ink-carrying channel 124 is pressurized by the fluid pump, a droplet of ink is immediately ejected therefrom as soon as the orifices 138, 140 are in communication with each other.

Thus, there has been described and illustrated herein, an ink jet printhead having a pressurized ink-carrying channel and a modulatable cover plate which controls the ejection of ink therefrom by the selective formation of an orifice in the cover plate. In this manner, the need for actuators which extend along the ink-carrying channel and which eject ink by imparting a pressure pulse into the ink-carrying channel has been eliminated, thereby resulting in a simplified method to construct a channel array for an ink jet printhead. However, those skilled in the art will recognize that many modifications and variations besides those specifically mentioned may be made in the techniques described herein without departing substantially from the concept of the present invention. Accordingly, it should be clearly understood that the form of the invention as described herein is exemplary only and is not intended as a limitation on the scope of the invention.

What is claimed is:

1. A drop on demand type jet printhead, comprising:

a main body portion having a front side surface and an ink-carrying channel axially extending from an interior surface of said main body portion to said front side surface;

means for supplying a pressurized flow of ink to said ink-carrying channel;

a cover plate having a front side surface and a rear side surface, said rear side surface mounted to said front side surface of said main body portion, said cover plate being formed of an active piezoelectric material; and means for applying an electric field across said cover plate to piezoelectrically deflect said cover plate from a first position in which said rear side surface blocks ejection of pressurized ink from said ink-carrying channel into a second position in which a path for the ejection of ink from said ink-carrying channel is produced by a piezoelectric deflection of said cover plate into said second position.

2. A drop on demand type ink jet printhead, comprising:

a main body portion having a front side surface and an ink-carrying channel axially extending from an interior surface of said main body portion to said front side surface;

means for supplying a pressurized flow of ink to said ink-carrying channel;

a cover plate having a front side surface and a rear side surface, said rear side surface mounted to said front side surface of said main body portion to block ejection of pressurized ink from said ink-carrying channel, said cover plate formed of an active piezoelectric material; and means for applying an electric field across said cover plate;

wherein said cover plate further comprises:

a first plate section having a first side surface; and a second plate section having a first side surface which lays flush with said first side surface of said first plate section;

wherein said application of said electric field separates said first side surface of said first plate section and said first side surface of said second plate section to form an orifice in communication with said ink-carrying channel for the ejection of ink therefrom.

3. A drop on demand type ink jet printhead according to claim 2 wherein said means for applying an electric field across said cover plate further comprises:

means for applying a first electric field across said first plate section to cause said first plate section to deflect in a first direction; and means for applying a second electric field across said second plate section to cause said second plate section to deflect in a second direction.

4. A drop on demand type ink jet printhead according to claim 2 wherein said first plate section is comprised of a piezoelectric material poled in a first direction generally orthogonal to a direction of axial extension of said ink-carrying channel and said second plate section is comprised of a piezoelectric material poled in a second direction generally orthogonal to the direction of axial extension of said ink-carrying channel and wherein said means for applying an electric field across said cover plate further comprises:

means for applying a first electric field across said first plate section and generally orthogonal to said first poling direction and the direction of axial extension of said ink-carrying channel to cause said first plate section to deflect in said first direction; and means for applying a second electric field across said second plate section and generally orthogonal to said second poling direction and the direction of axial extension of said ink-carrying channel to cause said second plate section to deflect in said second direction.

5. A drop on demand type ink jet printhead according to claim 4 wherein said first and said second plate section each comprise second and third side surfaces, and wherein said cover plate further comprises:

a first strip of conductive material mounted to said second side surfaces of said first and said second plate section; and a said second strip of conductive material mounted to said third side surfaces of said first and second plate section.

6. A drop on demand type ink jet printhead according to claim 5 and further comprising a controller having a first conductive lead and second conductive lead electrically connected to said first and said second conductive strip first, respectively, said controller simultaneously applying first and said second voltages to said first and second conductive strip, respectively, to produce a first and second plate section deflecting voltage differential therebetween.

7. A drop on demand type ink jet printhead according to claim 4 wherein said first plate section and said second plate section each comprise a second side surface and a third side surface and wherein said cover plate further comprises:

a first strip of conductive material mounted to said second side surface of said first plate section;

a second strip of conductive material mounted to said third side surface of said first plate section;

a third strip of conductive material mounted to said second side surface of said second plate section; and a fourth strip of conductive material mounted to said third side surface of said second plate section.

8. A drop on demand type ink jet printhead according to claim 7 and further comprising a controller having first, second, third and fourth conductive leads electrically connected to said first, said second, said third and said fourth conductive strip, respectively, said controller simultaneously applying first, second, third and fourth voltages to said first, said second, said third and said fourth conductive strip, respectively, to produce a first plate section deflecting voltage differential between said first and said second conductive strip and a second plate section deflecting voltage differential between said third and said fourth conductive strip.

9. A drop on demand type ink jet printhead, comprising:

a main body portion having a front side surface and an ink-carrying channel axially extending from an interior surface of said main body portion to said front side surface;

means for supplying a pressurized flow of ink to said ink-carrying channel;

a cover plate having a front side surface and a rear side surface, said rear side surface mounted to said front side surface of said main body portion to block ejection of pressurized ink from said ink-carrying channel, said cover plate formed of an active piezoelectric material; and means for applying an electric field across said cover plate;

wherein said cover plate further comprises:

a first plate section having a front side surface and a rear side surface fixedly mounted to said front side surface of said main body portion, said first plate section having a first aperture extending therethrough;

a second plate section having a front side surface and a rear side surface fixedly mounted to said front side surface of said first plate section, said second plate section having a second aperture extending therethrough;

said cover plate being displaceable between a first rest position and a second displaced position;

wherein, in said first position, said rear side surface of said first plate section blocks the ejection of pressurized ink from said ink-carrying channel and, in said second position, said pressurized ink is ejected through an orifice formed by said first and said second apertures.

10. A drop on demand type ink jet printhead according to claim 9 wherein, in both of said first and said second position, said first and said second aperture are in communication with each other and wherein, in said first position, said first and said second aperture have a first and a second diameter, respectively, insufficiently sized for the ejection of a droplet of pressurized ink therefrom and, in said second position, said first and said second aperture have a third and a fourth diameter, respectively, sufficiently sized for the ejection of a droplet of pressurized ink therefrom.

11. A drop on demand type ink jet printhead according to claim 9 wherein said first and said second aperture have a first and a second diameter, respectively, sufficiently sized for the ejection of a droplet of pressurized ink therefrom and wherein said first and said second aperture are formed at first and second locations on said first and said second plate section, respectively, such that, in said first position, said first and said second aperture are not in communication with each other and said rear side surface of said second plate section blocks the ejection of ink from said ink-carrying channel, and, in said second position, said first and said second aperture are in communication with each other.

12. A drop on demand type ink jet printhead, comprising:

a main body portion having a front side surface and a plurality of generally parallel ink-carrying channels axially extending from an interior surface of said main body portion to said front side surface;

means for supplying a pressurized flow of ink to each of said plurality of ink-carrying channels;

a frame fixedly mounted to said front side surface of said main body portion;

a plurality of cover plates, each of said cover plates formed from an active piezoelectric material and having a side surface front a and rear side surface, each of said cover plates mounted to said frame such that said rear side surface thereof covers one of said plurality of ink-carrying channels to block ejection of pressurized ink therefrom; and means for selectively applying an electric field across each of said cover plates;

wherein a path for the ejection of ink from each of said ink-carrying channels is provided by a displacement of a corresponding cover plate produced by said selective application of said electric field thereacross.

13. A drop on demand type ink jet printhead according to claim 12 wherein each of said cover plates further comprise:

a first plate section having a first side surface; and a second plate section having a second side surface which lays flush with said first side surface;

wherein said selective application of said electric field thereacross separates said first side surface of said first plate section and said second side surface of said second plate section to form an orifice in communication with said ink-carrying channel for the ejection of ink therefrom.

14. A drop on demand type ink jet printhead according to claim 13 wherein said means for selectively applying an electric field across each of said cover plates further comprises:

means for selectively applying a first electric field across each said first plate section to cause each said first plate section to selectively deflect in a first direction; and means for selectively applying a second electric field across each said second plate section to cause each said second plate section to selectively deflect in a second direction.

15. A drop on demand type ink jet printhead according to claim 13 wherein each said first plate section is comprised of a piezoelectric material poled in a first direction generally orthogonal to a direction of axial extension of said ink-carrying channels and each said second plate section is comprised of a piezoelectric material poled in a second direction generally orthogonal to the direction of axial extension of said ink-carrying channels and wherein said means for selectively applying an electric field across each of said cover plates further comprises:

means for selectively applying a first electric field across each said first plate section and generally orthogonal to said first poling direction and the direction of the axial extension of said ink-carrying channels to cause each said first plate section to selectively deflect in said first direction; and means for selectively applying a second electric field across each said second plate section and generally orthogonal to said second poling direction and the direction of axial extension of said ink-carrying channels to cause each said second plate section to selectively deflect in said second direction.

16. A drop on demand type ink jet printhead according to claim 15 wherein each of said first and second plate sections further comprise second and third side surfaces and wherein each of said cover plates further comprise:

a first strip of conductive material mounted to said second side surfaces of said first and second plate sections; and a second strip of conductive material mounted to said third side surfaces of said first and second plate sections.

* * * * *